US010993018B2

(12) United States Patent
Kikuchi et al.

(10) Patent No.: US 10,993,018 B2
(45) Date of Patent: Apr. 27, 2021

(54) SPEAKER APPARATUS

(71) Applicant: SONY CORPORATION, Tokyo (JP)

(72) Inventors: Kohei Kikuchi, Saitama (JP); Yohei Fukuma, Chiba (JP); Nobukazu Suzuki, Kanagawa (JP); Kazuhiro Matsutani, Chiba (JP); Yoshio Ohashi, Kanagawa (JP); Yasuo Kawabata, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 37 days.

(21) Appl. No.: 15/533,736

(22) PCT Filed: Nov. 9, 2015

(86) PCT No.: PCT/JP2015/081485
§ 371 (c)(1),
(2) Date: Jun. 7, 2017

(87) PCT Pub. No.: WO2016/103931
PCT Pub. Date: Jun. 30, 2016

(65) Prior Publication Data

US 2017/0332166 A1 Nov. 16, 2017

(30) Foreign Application Priority Data

Dec. 26, 2014 (JP) ..... JP2014-265426

(51) Int. Cl.
*H04R 1/24* (2006.01)
*H04R 1/06* (2006.01)
(Continued)

(52) U.S. Cl.
CPC ..... *H04R 1/24* (2013.01); *F21V 3/00* (2013.01); *F21V 23/001* (2013.01);
(Continued)

(58) Field of Classification Search
CPC . H04R 1/24; H04R 1/025; H04R 7/12; H04R 17/00; H04R 2115/10; H04R 1/06;
(Continued)

(56) References Cited

U.S. PATENT DOCUMENTS 3,329,235 A * 7/1967 Shaper ..... H04R 1/26 181/147
3,371,742 A * 3/1968 Norton ..... H04R 1/345 181/153
(Continued)

FOREIGN PATENT DOCUMENTS

CN 1980491 A 6/2007
DE 20201001538 U1 * 12/2010
(Continued)

OTHER PUBLICATIONS

International Search Report and Written Opinion of PCT Application No. PCT/JP20151081485, dated Jan. 26, 2016, 02 pages of English Translation and 07 pages of ISRWO.

*Primary Examiner* — Davetta W Goins
*Assistant Examiner* — Kuassi A Ganmavo
(74) *Attorney, Agent, or Firm* — Chip Law Group

(57) ABSTRACT

Generation of a secondary sound source is inhibited, and a sound quality is improved. Included are a support fixed to a mount base, a speaker unit including a portion to be fixed, and a base casing holding the speaker unit, and the speaker unit is fixed to the support and the base casing with the portion to be fixed being sandwiched between the support and the base casing. With this configuration, the speaker unit will be held stably, a great oscillation from a diaphragm of the speaker unit is less transmitted to the parts other than the diaphragm of the speaker unit, to the member holding the speaker unit, or the like. Generation of a secondary sound source is inhibited, and a sound quality can be improved.

8 Claims, 7 Drawing Sheets

(51) Int. Cl.

| | |
|---|---|
| ***H04R 17/00*** | (2006.01) |
| ***H04R 7/12*** | (2006.01) |
| ***F21V 3/00*** | (2015.01) |
| ***F21V 23/00*** | (2015.01) |
| ***F21V 33/00*** | (2006.01) |
| ***H04R 1/02*** | (2006.01) |
| ***H04R 1/26*** | (2006.01) |
| ***H04R 1/32*** | (2006.01) |
| ***H04R 3/14*** | (2006.01) |
| ***H04R 1/34*** | (2006.01) |
| ***H04R 1/28*** | (2006.01) |
| ***F21Y 115/10*** | (2016.01) |

(52) U.S. Cl.
CPC ..... *F21V 33/0056* (2013.01); *H04R 1/025* (2013.01); *H04R 1/06* (2013.01); *H04R 7/12* (2013.01); *H04R 17/00* (2013.01); *F21Y 2115/10* (2016.08); *H04R 1/02* (2013.01); *H04R 1/26* (2013.01); *H04R 1/2834* (2013.01); *H04R 1/323* (2013.01); *H04R 1/345* (2013.01); *H04R 3/14* (2013.01)

(58) Field of Classification Search
CPC ... H04R 1/26; H04R 1/32; H04R 1/34; H04R 1/28; F21V 3/00; F21V 23/001; F21V 33/0056; F21V 23/00; H01L 41/053; H01L 41/04; H01L 41/08; F21Y 115/10
See application file for complete search history.

(56) References Cited

U.S. PATENT DOCUMENTS 4,588,654 A * 5/1986 Kobuke ..... G11B 5/85 428/458
7,610,991 B2 * 11/2009 Suzuki ..... H04R 1/323 181/153
2003/0164405 A1 * 9/2003 Kienzler ..... F02M 63/0026 239/102.2
2004/0222038 A1 * 11/2004 Nakamura ..... H04R 1/02 181/199
2007/0133837 A1 6/2007 Suzuki et al.
2007/0186749 A1 * 8/2007 Suzuki ..... H04R 1/345 84/330
2008/0095395 A1 * 4/2008 Pieklik ..... H04R 1/028 381/387
2009/0175471 A1 * 7/2009 Suzuki ..... H04R 15/00 381/190
2010/0280922 A1 * 11/2010 Giovannotto ..... H05B 33/0857 705/26.5
2012/0063633 A1 * 3/2012 Suzuki ..... H04R 1/24 381/423
2014/0062263 A1 * 3/2014 Ogawa ..... H01L 41/0477 310/364

FOREIGN PATENT DOCUMENTS

| | | | |
|---|---|---|---|
| EP | 1796426 | A2 | 6/2007 |
| JP | 4-71094 | A1 * | 6/1992 |
| JP | 04-071094 | U | 6/1992 |
| JP | 1992-71094 | U | 6/1992 |
| JP | 05-063191 | U | 8/1993 |
| JP | 05-065194 | U | 8/1993 |
| JP | 1993-63191 | U | 8/1993 |
| JP | 1993-65194 | U | 8/1993 |
| JP | 7-298381 | A | 11/1995 |
| JP | 07-298381 | A | 11/1995 |
| JP | 2007-166027 | A | 6/2007 |
| JP | 2008-182452 | A | 8/2008 |
| JP | 2008-278064 | A | 11/2008 |
| JP | 4835138 | B2 | 12/2011 |
| KR | 10-2007-0061379 | A | 6/2007 |

* cited by examiner

SPEAKER APPARATUS

CROSS REFERENCE TO RELATED APPLICATIONS

This application is a U.S. National Phase of International Patent Application No. PCT/JP2015/081485 filed on Nov. 9, 2015, which claims priority benefit of Japanese Patent Application No. JP 2014-265426 filed in the Japan Patent Office on Dec. 26, 2014. Each of the above-referenced applications is hereby incorporated herein by reference in its entirety.

TECHNICAL FIELD

The present technology relates to a technical field of a speaker apparatus including a support fixed to a mount base, and a base casing that holds a speaker unit.

CITATION LIST

Patent Literature

Patent Literature 1: Japanese Patent No. 4835138

BACKGROUND ART

There are speaker apparatuses that output a sound (voice) having a predetermined frequency band. For example, one of the speaker apparatuses includes a support arranged on and fixed to a mount base such as a floor, and a base casing that holds a speaker unit (for example, see Patent Literature 1).

In the speaker apparatus described in Patent Literature 1, three legs are provided as the supports that are positioned separately in the circumferential direction, the base casing is supported by the legs, and the speaker unit is attached to and held by the base casing inside the legs.

In the speaker apparatus described in Patent Literature 1, the speaker unit functions as a woofer, and a sound is output from the speaker unit in a downward direction. The three legs form a space under the speaker unit, a low pitch sound output from the speaker unit is emitted from the downward space and spreads peripherally, whereby the sound quality is improved.

DISCLOSURE OF INVENTION

Technical Problem

Incidentally, in the speaker apparatus, a diaphragm of the speaker unit oscillates at the time of outputting a sound. At this time, in the case where the speaker unit is not held stably with respect to other members, a great oscillation from the diaphragm of the speaker unit is undesirably transmitted to the parts other than the diaphragm, to the base casing that holds the speaker unit, or the like. A good operation of the speaker unit is not ensured, a secondary sound source may be generated to output a sound from the parts other than the speaker unit, and a sound quality may be degraded.

It is an object of a speaker apparatus according to the present technology to overcome the above-described problems, to inhibit generation of a secondary sound source, and to improve a sound quality.

Solution to Problem

First, a speaker apparatus according to the present technology includes a support fixed to a mount base, a speaker unit including a portion to be fixed, and a base casing that holds the speaker unit, the speaker unit being fixed to the support and the base casing with the portion to be fixed being sandwiched between the support and the base casing.

With this configuration, since the portion to be fixed is sandwiched between the support and the base casing, the speaker unit will be held stably.

Second, in the above-described speaker apparatus, the base casing is formed into a tube shape, a plurality of the supports are provided in a circumferential direction of the base casing, and the portion to be fixed is fixed to the plurality of the supports.

With this configuration, since the portion to be fixed is fixed to the supports and the base casing at a plurality of points, the speaker unit is stably fixed to the supports and the base casing.

Third, in the above-described speaker apparatus, the speaker unit is provided with a diaphragm and a unit frame holding the diaphragm, the unit frame is provided with a flange extending outwardly, and the flange is the portion to be fixed.

With this configuration, the portion to be fixed that is a flange is sandwiched between the support and the base casing, and the speaker unit is fixed to the support and the base casing.

Fourth, in the above-described speaker apparatus, a speaker device that outputs a sound different from a sound output from the speaker unit is provided, output of the sound from the speaker device is performed by expansion and contraction of an oscillating element, and an arrangement portion where the oscillating element is arranged is formed on the base casing.

With this configuration, the oscillating element is arranged into the base casing having a function to hold the speaker unit.

Fifth, in the above-described speaker apparatus, the wiring connected to the oscillating element is arranged throughout inside the base casing, inside the portion to be fixed, and inside the support.

With this configuration, the base casing, the portion to be fixed, and the support function as the arrangement portion of the wiring.

Sixth, in the above-described speaker apparatus, the portion to be fixed is sandwiched between the support and the base casing and is fixed with a screw for fixation, an insertion hole that is penetrated in an axial direction is formed in the screw for fixation, and wiring is inserted into the insertion hole.

With this configuration, the screw for fixation does not interfere with the wiring.

Seventh, in the above-described speaker apparatus, the base casing is formed into a tube shape, and a lighting body is arranged inside the base casing.

With this configuration, the speaker apparatus has not only the sound output function but also the lighting function.

Advantageous Effects of Invention

According to the present technology, since the portion to be fixed is sandwiched between the supports and the base casing, the speaker unit will be held stably, a great oscillation from the diaphragm of the speaker unit is less transmitted to the parts other than the diaphragm of the speaker unit, to the member holding the speaker unit, or the like. Generation of a secondary sound source is inhibited, and the sound quality can be improved.

It should be noted that the effects described in the present specification are merely illustrative and are not limitative, and may have additive effects.

MODE(S) FOR CARRYING OUT THE INVENTION

Hereinafter, embodiments of a speaker apparatus according to the present technology will be described with reference to the drawings.

A stationary type speaker apparatus is described below by way of example. Note that the speaker apparatus according to the present technology is applied without being limited to the stationary type speaker apparatus. For example, the speaker apparatus according to the present technology is widely applicable to a variety of other kinds of speaker apparatuses such as a hanging type speaker apparatus that is hung from a ceiling and the like.

It should be noted that the up-and-down, front-and-back, and left-and-right directions described below are for convenience of the description, and the present technology is applied without being limited to these directions.

<Configuration of Speaker Apparatus>

Figure 1:
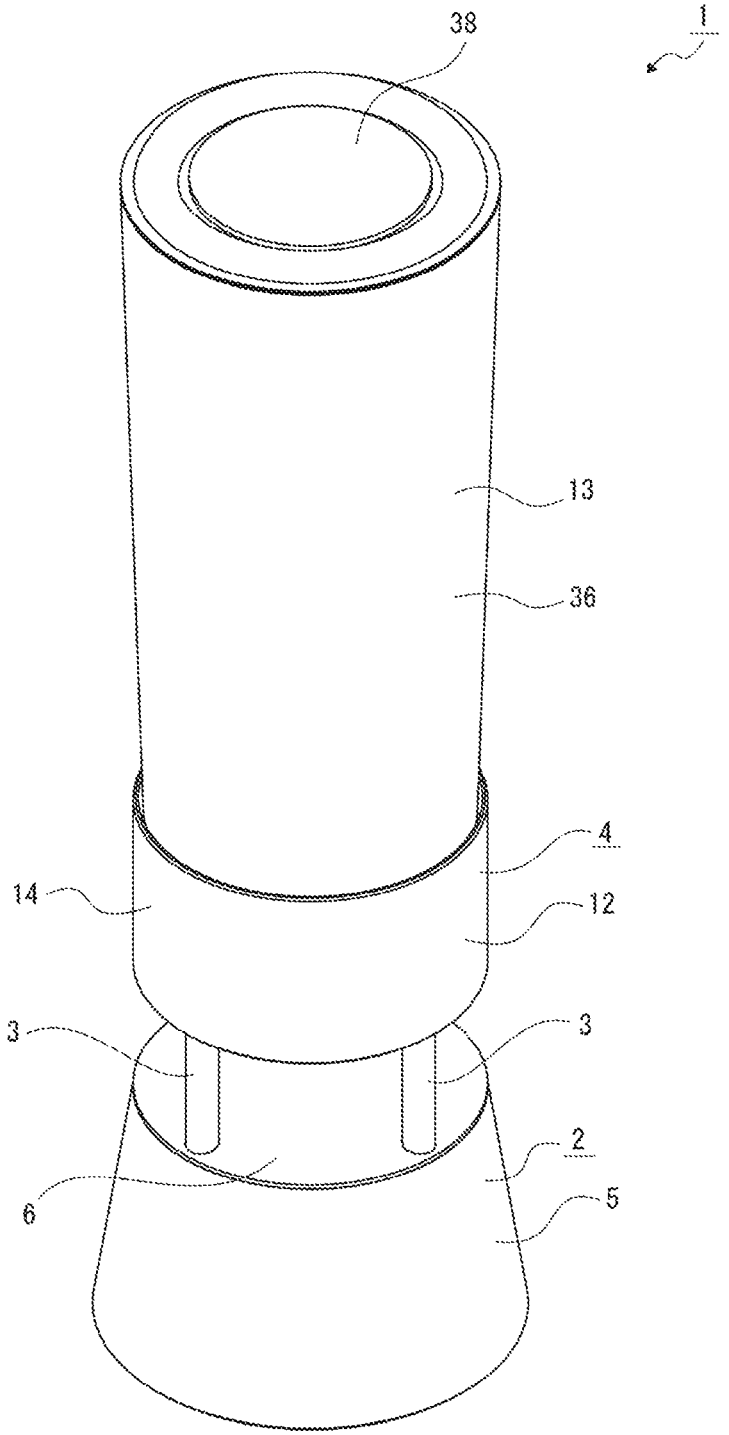
FIG. 1 shows an embodiment of a speaker apparatus according to the present technology together with FIG. 2 to FIG. 7, and is a perspective view of the speaker apparatus.

A speaker apparatus 1 includes a mount base 2 installed on a floor or the like, supports 3, 3, . . . coupled to the mount base 2 at lower ends, and a main body 4 coupled to upper ends of the supports 3, 3, . . . (see FIG. 1 to FIG. 3).

The mount base 2 includes an outer casing 5 including necessary portions arranged inside and a diffuser 6 attached to an upper end of the outer casing 5.

Figure 3:
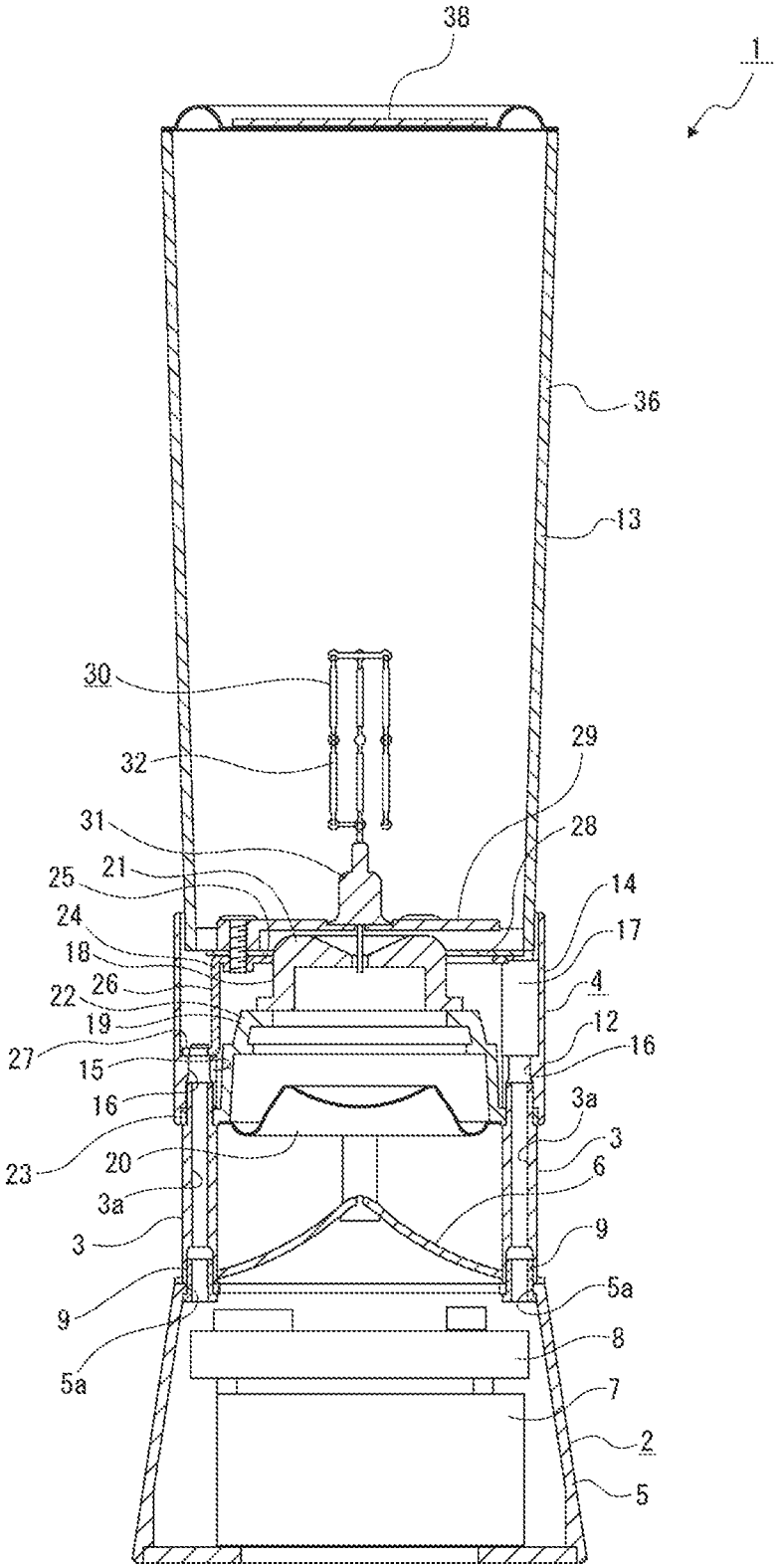
FIG. 3 is a cross-sectional view of the speaker apparatus cut in a different plane from FIG. 2.

A battery 7 and an electronic circuit 8 are arranged inside the outer casing 5 (see FIG. 3). Electric power of the battery 7 is fed to necessary portions of the main body 4 by the electronic circuit 8.

The diffuser 6 has a top at the center, and is formed to have a shape that is changed downwardly from the center to an outward direction.

The supports 3, 3, . . . are positioned separately at equal intervals in the circumferential direction. The support 3 is formed into a hollow cylindrical shape extending in the up-and-down direction, and the lower end of the support 3 penetrates the diffuser 6 and is coupled to the upper end of the outer casing 5.

Figure 4:
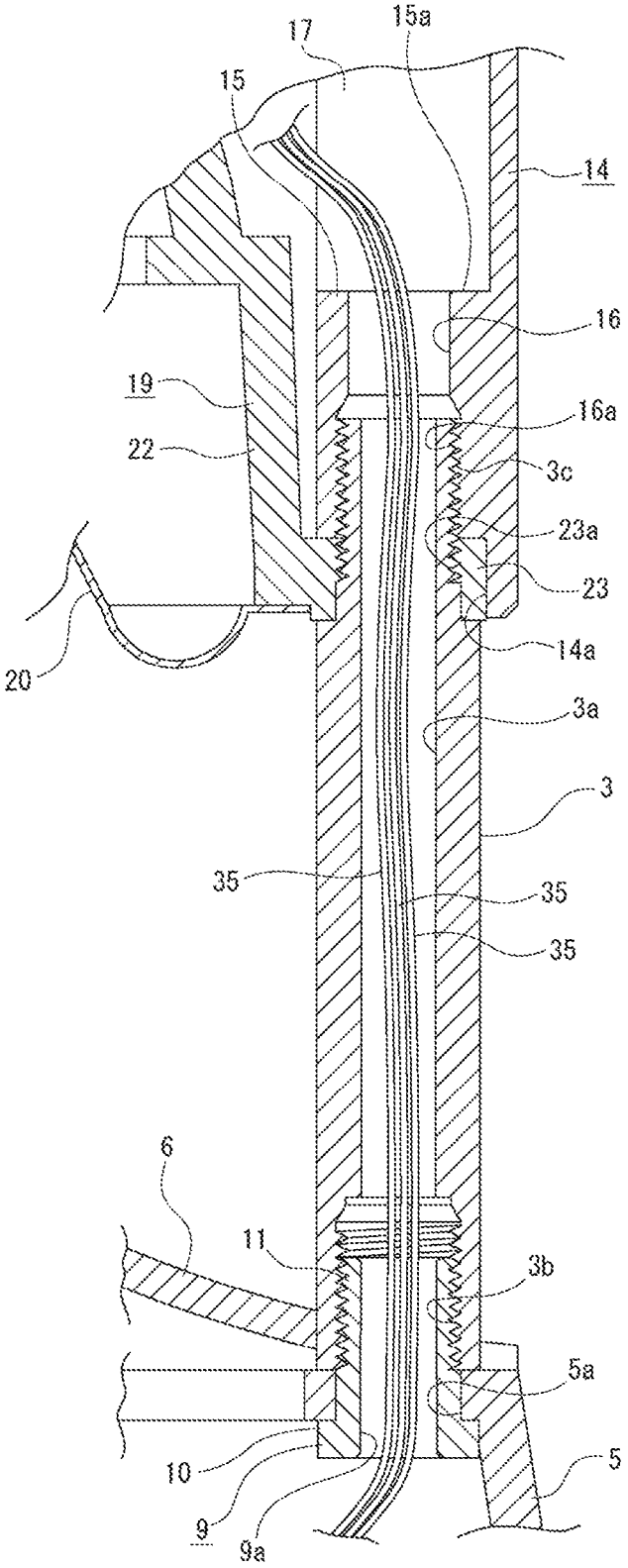
FIG. 4 is an enlarged cross-sectional view showing a fixing state of a support and other members.

An internal space of the support 3 is formed as a wiring arrangement space 3*a* (see FIG. 4). An inner face of the lower end of the support 3 is formed as a lower side screw groove 3*b*. A diameter of the support 3 at an upper end is one size smaller than other parts of the support 3. An outer face of the upper end is formed as an upper side screw groove 3*c*.

The support 3 is attached to the outer casing 5 by a screw for fixation 9. The screw for fixation 9 includes a head 10 and a screw shaft 11. An internal space of the screw for fixation 9 is formed as an insertion hole 9*a*.

With the head 10 being lower than the screw shaft 11, the screw for fixation 9 is inserted into a screw insertion hole 5*a* formed at the upper end of the outer casing 5, and the screw shaft 11 is screwed into the lower side screw groove 3*b*. Thus, the lower end of the support 3 is fixed to the outer casing 5 by the screw for fixation 9. With the support 3 being fixed to the outer casing 5, an internal space of the outer casing 5 is communicated with the wiring arrangement space 3*a* of the support 3 through the insertion hole 9*a* of the screw for fixation 9.

Figure 2:
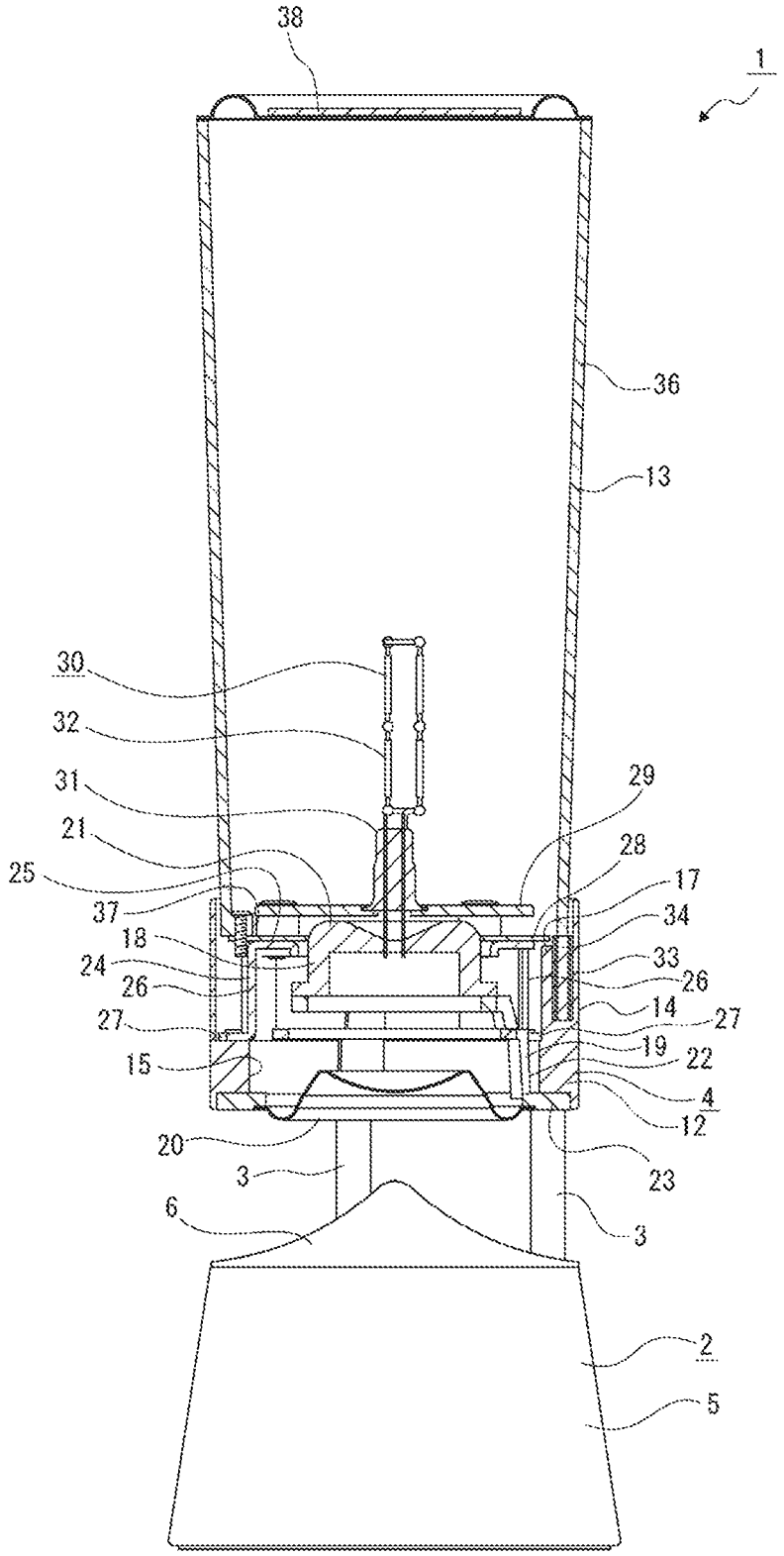
FIG. 2 is a cross-sectional view of the speaker apparatus.
Figure 5:
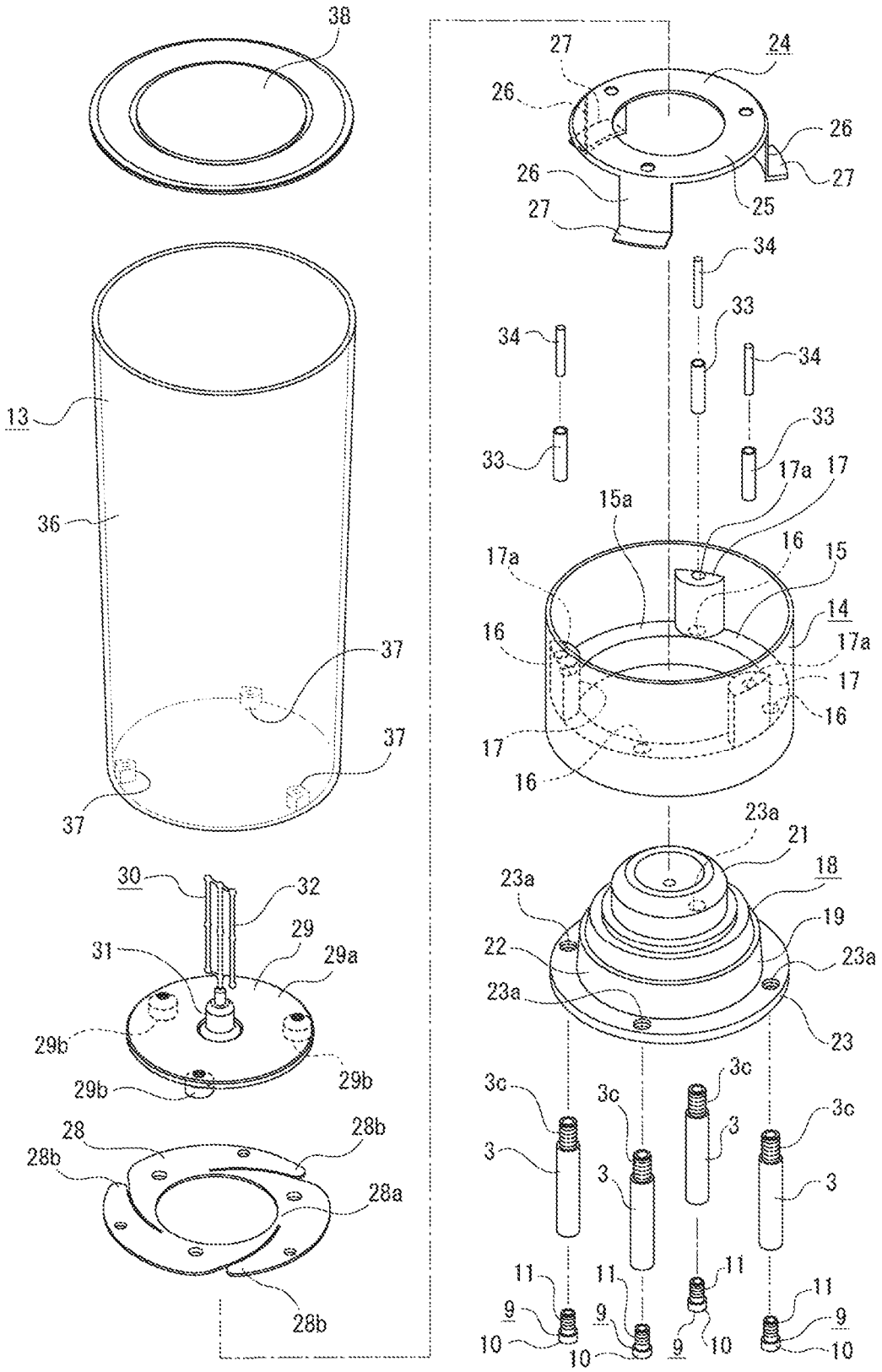
FIG. 5 is an exploded perspective view of the speaker apparatus.

The main body 4 includes a mechanism unit 12 and an oscillating body 13 (see FIG. 2, FIG. 3, and FIG. 5).

The mechanism unit 12 includes a base casing 14 and necessary portions that are arranged inside the base casing 14.

Figure 6:
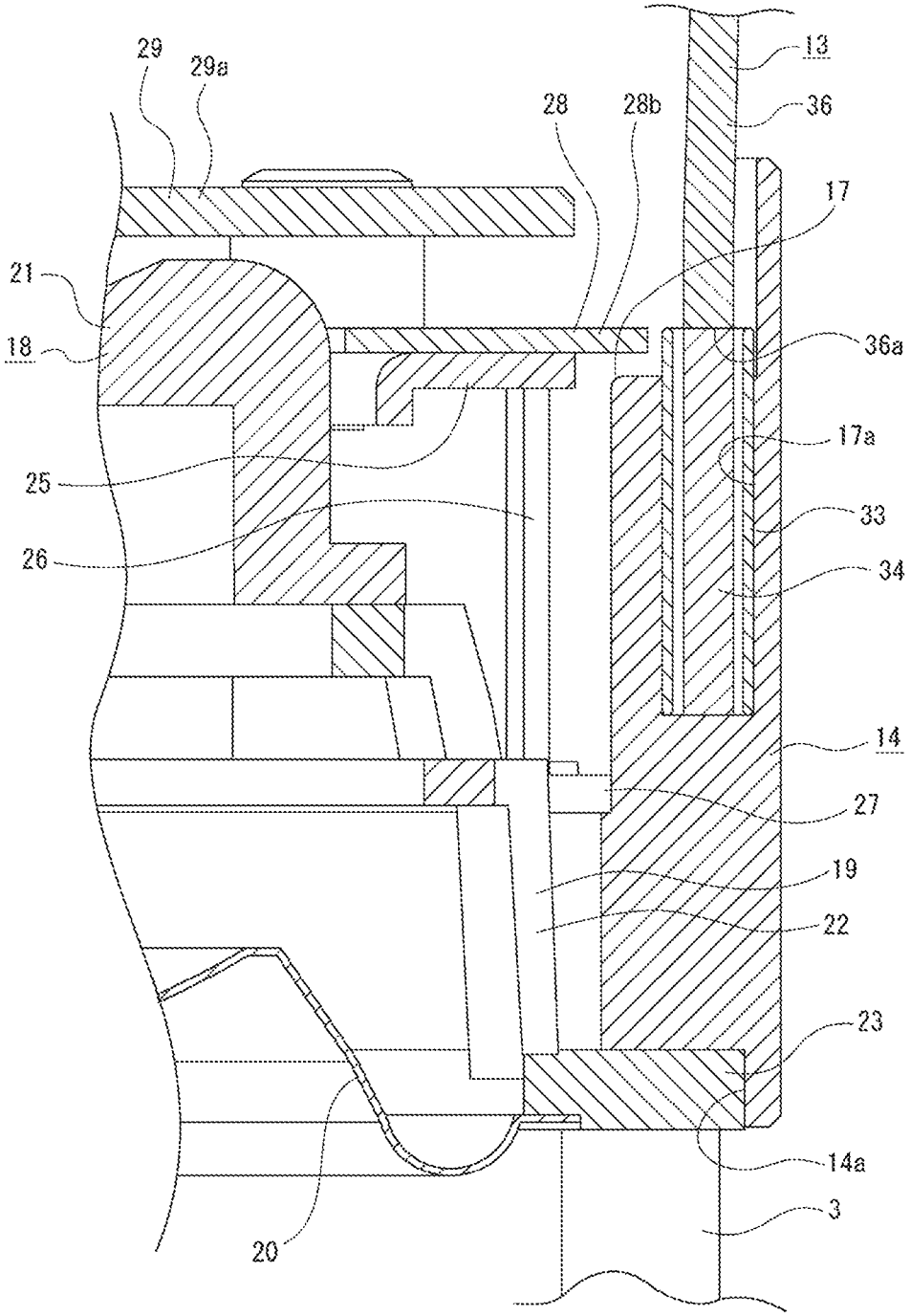
FIG. 6 is an enlarged cross-sectional view showing an arrangement state of an oscillating element with respect to an arrangement portion.

For example, the base casing 14 is formed of a light-weight metal material such as aluminum in a substantially hollow cylindrical shape, and has at the lower end a circular-shaped notch for arrangement 14*a* that is open downwardly and inwardly (see FIG. 4 and FIG. 6). The base casing 14 is provided on a lower side with an extension 15 extending inwardly more than other parts of the base casing 14. An upper face of the extension 15 is formed as a pedestal face 15*a*. The extension 15 has through holes 16, 16, . . . that penetrate the extension 15 in the up-and-down direction and are formed separately at equal intervals in the circumferential direction. A lower half periphery of the through hole 16 is formed as a screwing part 16*a* having a screw groove (see FIG. 4).

The base casing 14 has arrangement portions 17, 17, and 17 protruded inwardly on an inner periphery and being continuous with the upper side of the extension 15. The arrangement portions 17, 17, and 17 are formed separately at equal intervals in the circumferential direction. The arrangement portion 17 has an element arrangement hole 17*a* formed to be open upwardly.

A speaker unit 18 is attached to the lower end of the base casing 14 (see FIG. 4 and FIG. 6). For example, the speaker unit 18 is provided as a woofer, and has a function to output a low pitch sound (voice). The speaker unit 18 is attached so as to close the opening of the lower side of the base casing 14.

The speaker unit 18 includes a unit frame 19 formed circularly, a diaphragm 20 attached to a lower end of the unit frame 19, a closing member 21 attached to an upper end of the unit frame 19, and a magnetic circuit (not shown) arranged inside.

The unit frame 19 includes a frame main body 22, and a portion to be fixed 23 that is a flange extending outwardly from a lower end of the frame main body 22. The unit frame 19 and the portion to be fixed 23 constitute a frame of the speaker unit 18. The portion to be fixed 23 includes screw holes 23*a*, 23*a*, . . . formed separately at equal intervals in the circumferential direction.

The speaker unit 18 is fixed to the base casing 14 by the supports 3, 3, . . . . The speaker unit 18 is attached to the base casing 14 by inserting and arranging the portion to be fixed 23 into the notch for arrangement 14*a* of the base casing 14, and by consecutively screwing the upper side screw groove 3*c* of the support 3 into the screw hole 23*a* and the screwing part 16*a* formed in the extension 15 of the base casing 14.

With the speaker unit 18 being attached to the base casing 14, the portion to be fixed 23 is sandwiched between the base casing 14 and the supports 3, 3, . . . from above and below, and the wiring arrangement spaces 3*a*, 3*a*, . . . of the supports 3, 3, . . . are communicated with an internal space of the base casing 14 through the through holes 16, 16, . . . of the base casing 14.

Thus, in the speaker apparatus 1, the speaker unit 18 is provided with the diaphragm 20 and the unit frame 19 holding the diaphragm 20, and the unit frame 19 has the portion to be fixed 23 that is the flange extending outwardly.

Accordingly, since the speaker unit 18 is fixed to the support 3 and the base casing 14 with the portion to be fixed 23 being sandwiched between the support 3 and the base casing 14, the support 3, the speaker unit 18, and the speaker unit 18 can be easily connected in one time process, and the speaker apparatus 1 can have a simplified structure.

As described above, the speaker unit 18 is fixed to the supports 3, 3, . . . and the base casing 14, and the supports 3, 3, . . . and the base casing 14 function as a sound earth of the speaker unit 18.

A bracket 24 is attached to the base casing 14 (see FIG. 2, FIG. 3, and FIG. 5). The bracket 24 includes a planar attachment 25 formed into a circular shape, legs 26, 26, and 26 respectively protruded from the planar attachment 25 in the downward direction, and portions to be attached 27, 27, and 27 respectively protruded from the lower ends of the legs 26, 26, and 26 in the outward direction. The planar attachment 25 has an outside diameter smaller than an inside diameter of the base casing 14. The legs 26, 26, and 26 are positioned at equal intervals in the circumferential direction.

The bracket 24 is attached by, e.g., screwing the portions to be attached 27, 27, and 27 to the pedestal face 15*a* formed on the extension 15 of the base casing 14. With the bracket 24 being attached to the base casing 14, a circular-shaped gap having a certain size is formed between the planar attachment 25 and the base casing 14 (see FIG. 6), and the closing member 21 of the speaker unit 18 is inserted from below and positioned at the planar attachment 25.

An urging spring 28 and an attachment member 29 are attached to the planar attachment 25 of the bracket 24.

The urging spring 28 includes a base plane portion 28*a* formed into a substantially circular shape and elastic deformation portions 28*b*, 28*b*, and 28*b* protruded from the base plane portion 28*a* in the circumferential direction. The elastic deformation portions 28*b*, 28*b*, and 28*b* are formed into a shape extending in the circumferential direction and are positioned along the base plane portion 28*a* on an outer periphery of the base plane portion 28*a*.

The base plane portion 28*a* of the urging spring 28 is attached, e.g., screwed, to an upper face of the planar attachment 25 of the bracket 24, and at least parts of the elastic deformation portions 28*b*, 28*b*, and 28*b* are each positioned outside the planar attachment 25.

The attachment member 29 includes a substantially disk-shaped attachment portion 29*a* and protrusions to be attached 29*b*, 29*b*, and 29*b* protruded downwardly from an outer periphery of the attachment portion 29*a*. The protrusions to be attached 29*b*, 29*b*, and 29*b* of the attachment member 29 are jointed with the base plane portion 28*a* of the urging spring 28, which is attached to the upper face of the planar attachment 25 of the bracket 24 from an upper side of the urging spring 28.

A lighting body 30 is attached to the center of the attachment member 29. The lighting body 30 includes a stand 31 and a light emitter 32 that is held by the stand 31 and functions as lighting. For example, a light emitting element such as a light emitting diode is used as the light emitter 32. The stand 31 of the lighting body 30 is attached to the center of the upper face of the attachment portion 29*a*.

Protection tubes 33, 33, and 33 are inserted and arranged into the element arrangement holes 17*a*, 17*a*, and 17*a* of the arrangement portions 17, 17, and 17, respectively (see FIG. 5 and FIG. 6). The protection tube 33 has an axial direction as the up-and-down direction, is formed of a resin material in a tube shape, and is arranged so as to fit into the element arrangement hole 17*a*.

A lower end face of an oscillating element 34 is in contact with a bottom face of the element arrangement hole 17*a*. For example, the oscillating element 34 is a laminated type piezoelectric element, is formed into a shape extending in the up-and-down direction, and has an expanding and contracting direction in the up-and-down direction when a voltage (drive signal) is applied.

It should be noted that the oscillating element 34 is not limited to the piezoelectric element, and may be any expanding and contracting element, e.g., other element such as a magnetostrictor.

The oscillating elements 34, 34, and 34 inside the protection tubes 33, 33, and 33 are inserted and arranged into the element arrangement holes 17*a*, 17*a*, and 17*a* of the arrangement portion 17, 17, and 17.

The oscillating element 34 is arranged inside the protection tube 33 with a small gap. Thus, in the case where the oscillating element 34 is expanded and contracted, and expansion and contraction repeatedly occur in the radial direction, the oscillating element 34 is not in contact with the periphery of the element arrangement groove 17*a*, and the oscillating element 34 is protected. Also, the protection tube 33 prevents the oscillating element 34 from leaning on the arrangement portion 17.

Wiring 35, 35, . . . is inserted and arranged into the wiring arrangement spaces 3*a*, 3*a*, . . . of the supports 3, 3, . . . (see FIG. 4). The wiring 35 is connected at one end to the electronic circuit 8 arranged in the mount base 2, and has a function to output electric power or a drive signal to the oscillating element 34, the speaker unit 18, or the lighting body 30.

The wiring 35 is connected at the other end to the oscillating element 34, the speaker unit 18, or the lighting body 30 while passing from inside the mount base 2 to the insertion hole 9*a* of the screw for fixation 9, the wiring arrangement space 3*a*, the screw hole 23*a* of the portion to be fixed 23 in the speaker unit 18, and the through hole 16 of the base casing 14.

In this manner, since the wiring 35 connected to the oscillating element 34 and the like is arranged throughout inside the base casing 14, inside the portion to be fixed 23, and inside the support 3, the base casing 14, the portion to be fixed 23, and the support 3 function as the arrangement portion of the wiring 35, and the speaker apparatus 1 can have a simplified structure.

In addition, the portion to be fixed 23 of the speaker unit 18 is sandwiched between the support 3 and the base casing 14 and is fixed with the screw for fixation 9, the insertion hole 9*a* that is penetrated in the axial direction is formed in the screw for fixation 9, and the wiring 35 is inserted into the insertion hole 9*a*.

Accordingly, since the screw for fixation 9 does not interfere with the wiring 35, the wiring 35 can be arranged without affecting fixing of the portion to be fixed 23 to the support 3 and the base casing 14.

The oscillating body 13 functions as a sound diaphragm, and includes an oscillator 36 formed into a hollow cylindrical shape and having a diameter one size smaller than the base casing 14, and protrusions 37, 37, and 37 for connection protruded inwardly from the lower end of the oscillator 36. The protrusions 37, 37, and 37 for connection are positioned at equal intervals in the circumferential direction. The oscillating body 13 is formed of acrylic resin, for example.

The protrusions 37, 37, and 37 for connection of the oscillating body 13 are attached, e.g., screwed, to the elastic deformation portions 28*b*, 28*b*, and 28*b* of the urging spring 28 from the upper side, and an end face 36*a* of the oscillator 36 on a lower side is positioned directly above the oscillating elements 34, 34, and 34. The oscillating body 13 is attached to the urging spring 28, and is urged downwardly by an urging force of the urging spring 28.

Thus, the end face 36*a* of the oscillating body 13 on the lower side is pressed from above against an upper end face of the oscillating elements 34, 34, and 34 by the urging spring 28.

A passive radiator 38 is attached to the oscillating body 13 on the upper end. The passive radiator 38 is used as a subwoofer, for example, and has a function to output a low pitch sound by oscillation of the oscillating body 13. The passive radiator 38 is formed of a translucent material, for example. Light outgoing from the light emitter 32 is made to be permeable through the passive radiator 38.

<Operation of Speaker Apparatus>

In the speaker apparatus 1 as configured above, the low pitch sound is output from the speaker unit 18 that functions as the woofer, as described above. The sound output from the speaker unit 18 is reflected in a radiation direction by the diffuser 6 positioned downwardly of the speaker unit 18, and the sound is transmitted over a wide range.

On the other hand, in the case where a drive signal is input from the electronic circuit 8 to the oscillating elements 34, 34, and 34, the oscillating elements 34, 34, and 34 are expanded and contracted in the up-and-down direction in response to the input drive signal, and the oscillating body 13 pressed against the oscillating elements 34, 34, and 34 is oscillated. In the case where the oscillating body 13 is oscillated, a mid to high pitch sound is output. Thus, the oscillating body 13 functions as a sound diaphragm of a tweeter.

In the speaker apparatus 1, since the oscillating body 13 is formed into the tube shape, and a plurality of the oscillating elements 34, 34, and 34 are arranged separately in the circumferential direction of the oscillating body 13, the above-described oscillating body 13 is oscillated stably by the plurality of the oscillating elements 34, 34, and 34 arranged separately in the circumferential direction. Thus, the sound quality can be improved.

Furthermore, the end face 36*a* of the oscillating body 13 on the lower side is urged in a direction that is pressed to the oscillating elements 34, 34, and 34 by the elastic deformation portions 28*b*, 28*b*, and 28*b* of the urging spring 28 positioned at equal intervals in the circumferential direction.

Thus, an equal urging force is applied to the end face 36*a* of the oscillating body 13 on the lower side from the elastic deformation portions 28*b*, 28*b*, and 28*b*, the oscillating body 13 is pressed stably against the oscillating elements 34, 34, and 34, and a stable oscillation state of the oscillating body 13 can be ensured.

Furthermore, the speaker apparatus 1 is provided with a speaker device having the oscillating body 13 that outputs a sound different from the sound output from the speaker unit 18. The output of the sound from the speaker device is performed by driving of the oscillating elements 34, 34, and 34. The base casing 14 is provided with the arrangement portions 17, 17, and 17 where the oscillating elements 34, 34, and 34 are arranged.

In this manner, since the oscillating elements 34, 34, and 34 are arranged into the base casing 14 having a function to hold the speaker unit 18, the functionality of the base casing 14 can be improved, and the speaker apparatus 1 can have a simplified structure.

<Conclusion>

As described above, the speaker apparatus 1 includes the supports 3, 3, . . . fixed to the mount base 2, the speaker unit 18 having the portion to be fixed 23, and the base casing 14 that holds the speaker unit 18, and the speaker unit 18 is fixed to the supports 3, 3, . . . and the base casing 14 with the portion to be fixed 23 being sandwiched between the supports 3, 3, . . . and the base casing 14.

Thus, since the portion to be fixed 23 is sandwiched between the supports 3, 3, . . . and the base casing 14 functioning as the sound earth, the speaker unit 18 will be held stably, a great oscillation from the diaphragm 20 of the speaker unit 18 is less transmitted to the parts other than the diaphragm 20, to the base casing 14 that holds the speaker unit 18, or the like. Generation of a secondary sound source is inhibited, and the sound quality can be improved.

In addition, the base casing 14 is formed into the tube shape, the plurality of the supports 3, 3, . . . are provided in the circumferential direction of the base casing 14, and the portion to be fixed 23 of the speaker unit 18 is fixed to the plurality of the supports 3, 3, . . . .

Thus, since the portion to be fixed 23 is fixed to the supports 3, 3, . . . and the base casing 14 at a plurality of points, the speaker unit 18 is stably fixed to the supports 3, 3, . . . and the base casing 14, the speaker unit 18 and its surroundings are less oscillated, and the sound quality can be further improved.

Additionally, since the base casing 14 is formed into a tube shape, and the lighting body 30 is arranged inside the base casing 14, the speaker apparatus 1 has not only the sound output function but also the lighting function, and the functionality of the speaker apparatus 1 can be improved.

<Others>

Although the three elastic deformation portions 28*b* of the urging spring 28 and the three oscillating elements 34 are arranged in the above by way of example, the numbers of the elastic deformation portions 28*b* of the urging spring 28 and the oscillating elements 34 are not limited to three, and may be two or less, or four or more.

Also, although the elastic deformation portions 28*b* of the urging spring 28 and the oscillating elements 34 are positioned separately at equal intervals in the circumferential direction in the above by way of example, arrangement positions of the elastic deformation portions 28*b* of the urging spring 28 and the oscillating elements 34 are arbitrary.

It should be noted that in the case where the speaker apparatus 1 is of a hanging type, the main body 4 may be hung from a ceiling or the like by the support 3, for example.

Figure 7:
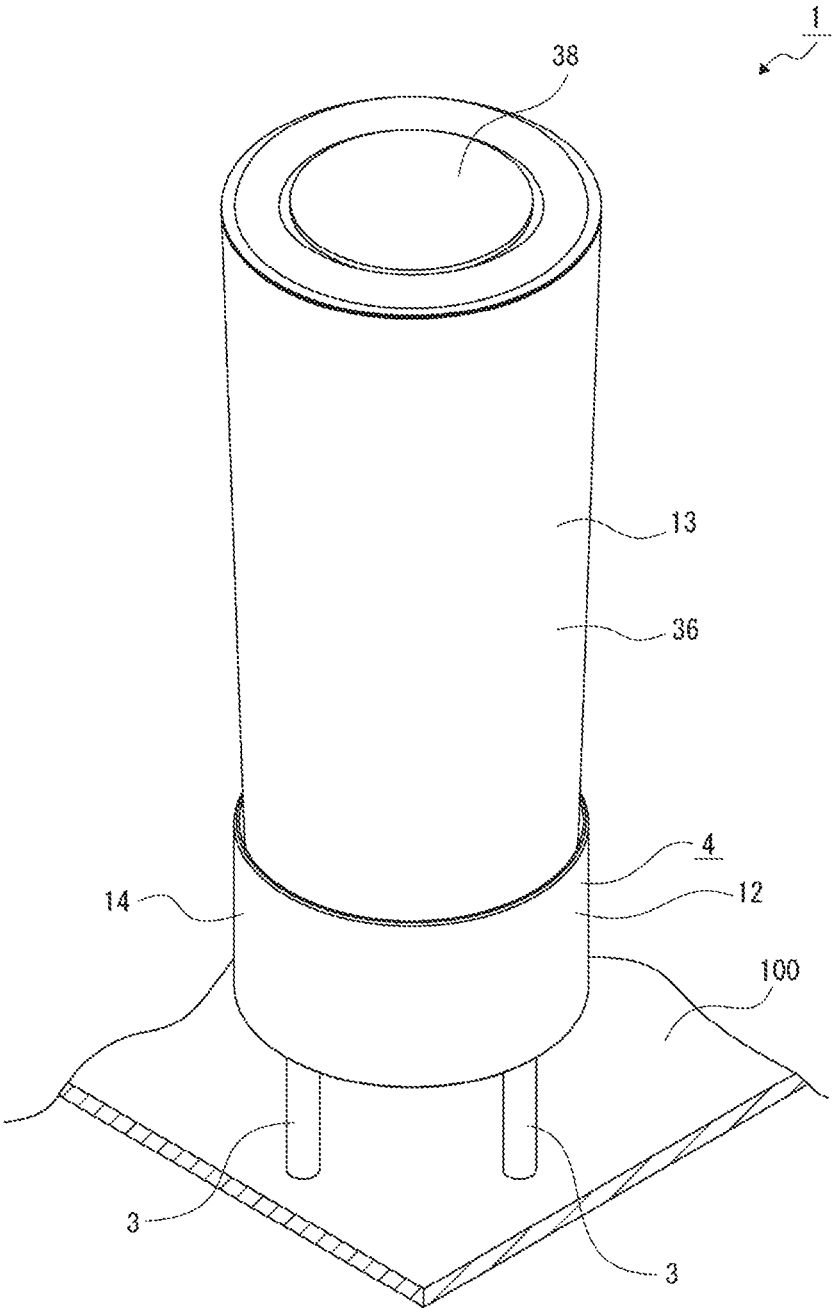
FIG. 7 is a perspective view showing an installing surface as a mount base by way of example.

In addition, in the case where the speaker apparatus 1 is of a stationary type, an installing surface 100 such as a floor may function as a mount base, and the support 3 may be fixed to the installing surface 100 such as the floor, as shown in FIG. 7, for example. In this case, the battery 7 and the electronic circuit 8 may be arranged inside the base casing 14, for example.

<Present Technology>

The present technology may have the following configurations.

(1) A speaker apparatus, including:

a support fixed to a mount base;

a speaker unit including a portion to be fixed; and a base casing that holds the speaker unit, the speaker unit being fixed to the support and the base casing with the portion to be fixed being sandwiched between the support and the base casing.

(2) The speaker apparatus according to (1), in which the base casing is formed into a tube shape, a plurality of the supports are provided in a circumferential direction of the base casing, and the portion to be fixed is fixed to the plurality of the supports.

(3) The speaker apparatus according to (1) or (2), in which the speaker unit is provided with a diaphragm and a unit frame holding the diaphragm, the unit frame is provided with a flange extending outwardly, and the flange is the portion to be fixed.

(4) The speaker apparatus according to one of (1) to (3), in which a speaker device that outputs a sound different from a sound output from the speaker unit is provided, output of the sound from the speaker device is performed by expansion and contraction of an oscillating element, and an arrangement portion where the oscillating element is arranged is formed on the base casing.

(5) The speaker apparatus according to one of (1) to (4), in which the wiring connected to the oscillating element is arranged throughout inside the base casing, inside the portion to be fixed, and inside the support.

(6) The speaker apparatus according to (5), in which the portion to be fixed is sandwiched between the support and the base casing and is fixed with a screw for fixation, an insertion hole that is penetrated in an axial direction is formed in the screw for fixation, and wiring is inserted into the insertion hole.

(7) The speaker apparatus according to one of (1) to (6), in which the base casing is formed into a tube shape, and a lighting body is arranged inside the base casing.

REFERENCE SIGNS LIST

1 speaker apparatus
2 mount base
3 support
9 screw for fixation
9*a* insertion hole
14 base casing
17 arrangement portion
18 speaker unit
19 unit frame
20 diaphragm
23 portion to be fixed
30 lighting body
33 protection tube
34 oscillating element
35 wiring

The invention claimed is:

1. A speaker apparatus, comprising:

at least one support body;

a speaker unit that includes a flange;

a base casing that holds the speaker unit, wherein the flange is between the at least one support body and the base casing, and the base casing comprises:

at least one arrangement portion that protrudes inwardly from an inner periphery of the base casing; and a protection tube inside the at least one arrangement portion;

an oscillating body that includes an oscillator having a hollow cylindrical shape, wherein the oscillating body is connected to the base casing, the oscillating body is a first diaphragm, and a diameter of the oscillator is smaller than a diameter of the base casing;

an urging spring attached to the oscillating body; and a plurality of oscillating elements, wherein the plurality of oscillating elements is in a circumferential direction of the oscillating body, and an oscillating element of the plurality of oscillating elements is inside the protection tube, and an end face of the oscillator is pressed against the oscillating element by the urging spring inside the base casing.

2. The speaker apparatus according to claim 1, wherein a shape of the base casing is a tube shape, the at least one support body is in a circumferential direction of the base casing, and the flange is fixed to the at least one support body.

3. The speaker apparatus according to claim 1, wherein the speaker unit further includes:

a second diaphragm; and a unit frame that holds the second diaphragm, the unit frame includes the flange, and the flange extends in an outward direction of the unit frame.

4. The speaker apparatus according to claim 1, wherein the speaker unit is configured to output a first sound, the speaker apparatus further comprises a speaker device, the speaker device is configured to output a second sound based on expansion and contraction of the oscillating element in an up-and-down direction, and the second sound is different from the first sound.

5. The speaker apparatus according to claim 4, further comprising a wiring inside at least one of the base casing, the flange, or the at least one support body, wherein the wiring is connected to the oscillating element.

6. The speaker apparatus according to claim 5, further comprising a screw that includes an insertion hole in an axial direction of the screw, wherein the flange is between the at least one support body and the base casing with the screw, and the wiring passes via the insertion hole.

7. The speaker apparatus according to claim 1, further comprising a light emitter in the base casing, wherein a shape of the base casing is a tube shape.

8. The speaker apparatus according to claim 1, further comprising a plurality of arrangement portions that includes the at least one arrangement portion, wherein the plurality of arrangement portions is in a circumferential direction of the base casing, and each arrangement portion of the plurality of arrangement portions is separated from remaining of the plurality of arrangement portions at an equal distance in the circumferential direction of the base casing.

* * * * *